United States Patent [19]

Tengler et al.

[11] Patent Number: 4,722,692

[45] Date of Patent: Feb. 2, 1988

[54] CABLE TERMINATION ASSEMBLY, NIPPING AND KNUCKLING MACHINE, AND METHOD

[75] Inventors: John N. Tengler; Dennis J. London; Chris A. Shmatovich, all of Chico, Calif.

[73] Assignee: Minnesota Mining and Manufacturing Company, St. Paul, Minn.

[21] Appl. No.: 816,551

[22] Filed: Jan. 6, 1986

[51] Int. Cl.[4] ..... H01R 4/66

[52] U.S. Cl. ..... 439/92; 439/449; 439/494; 439/497

[58] Field of Search ..... 339/17 F, 176 MF, 14 R, 339/103 R, 103 M, 218 R, 218 M, 102 R; 439/492–499, 607, 610, 449, 456, 479, 92

[56] References Cited

U.S. PATENT DOCUMENTS

| | | | |
|---|---|---|---|
| 3,909,261 | 9/1975 | Cooney | 339/103 M X |
| 4,310,208 | 1/1982 | Webster et al. | 339/17 F X |
| 4,488,763 | 12/1984 | Ritter | 339/17 F |
| 4,547,028 | 10/1985 | Morgan | 339/21 BM X |
| 4,586,776 | 5/1986 | Ollis et al. | 339/176 MF X |
| 4,596,428 | 6/1986 | Tengler | 339/17 F X |

*Primary Examiner*—Eugene F. Desmond

*Attorney, Agent, or Firm*—Renner, Otto, Boisselle & Lyon

[57] ABSTRACT

A cable termination assembly, includes a multiconductor electrical cable having plural electrical conductors and insulation, electrical contacts for effecting electrical connection between a respective conductor of said cable and a further member, said electrical contacts having a connecting means for connecting with a respective conductor of said cable and having contacting means for contacting with such further member, a separation between two adjacent parts of said insulation for exposing a portion of plural conductors along the major axial extent thereof, at least one of said conductors including at said separation a knuckle bent out of the major axial extent of the conductor for connecting with the connecting means of a respective electrical contacts, and at least a second of said conductors being generally continuous in the major axial extent thereof at said separation, at least one of said insulation parts having been slid along said second of said conductors to close the axial distance of said separation while also pushing part of said knuckles further away from the major axial extent of said one of said conductors, and a support for supporting said cable and contacts relatively fixed positions with respect to each other.

The invention also relates to apparatus for preparing such cable for use in such cable termination assembly and to a method for making a cable termination assembly.

18 Claims, 48 Drawing Figures

FIG. 10
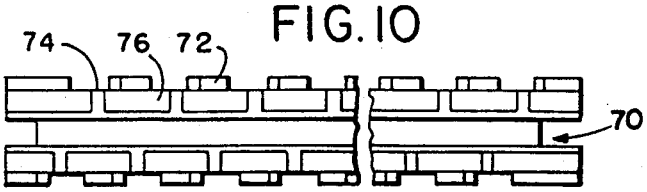
FIG. 9
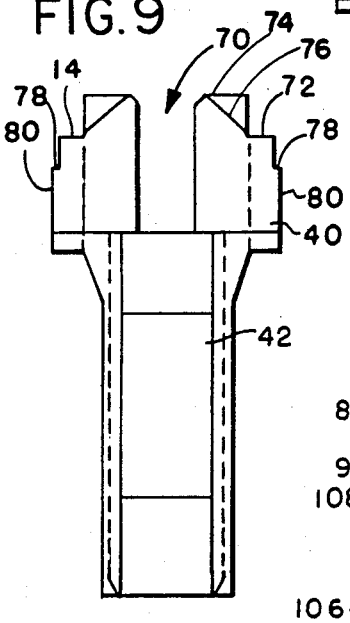
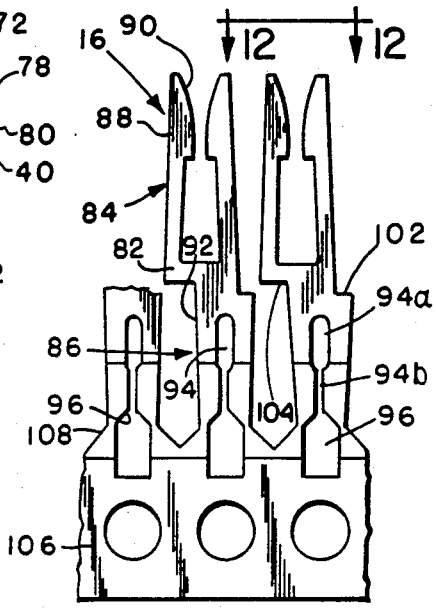
FIG. 11
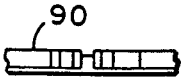
FIG. 12
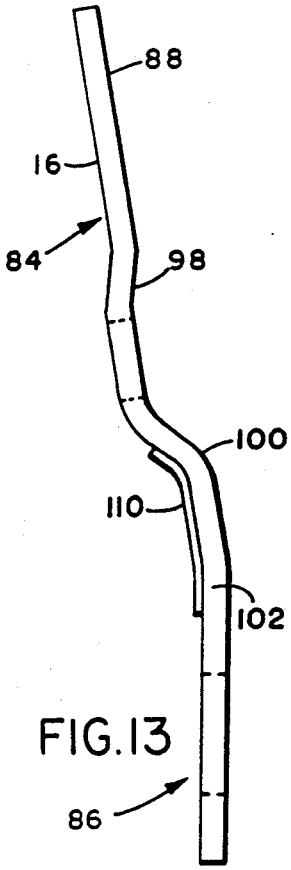
FIG. 13
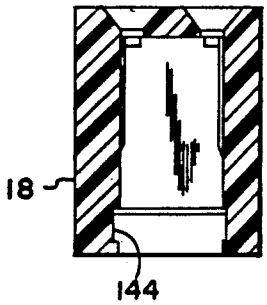
FIG. 15
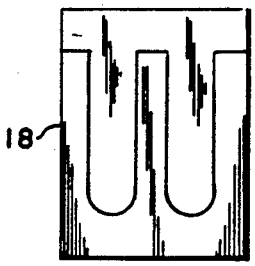
FIG. 16

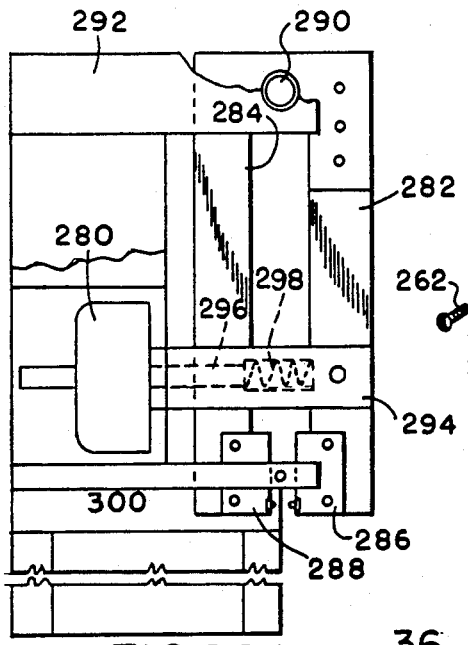
FIG.28
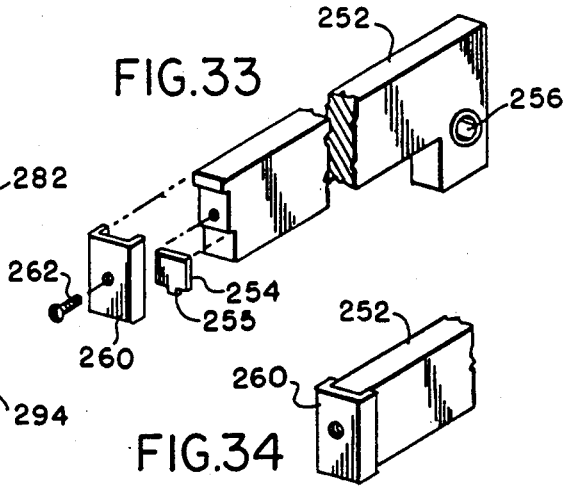
FIG.33
FIG.34
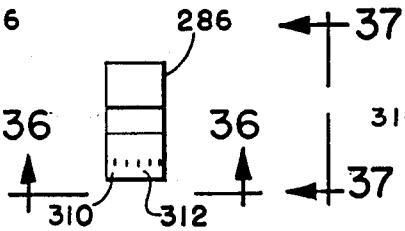
FIG.35
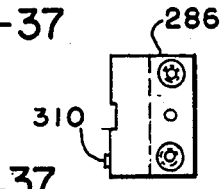
FIG.37
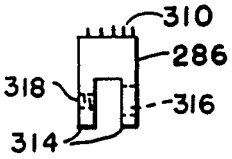
FIG.36
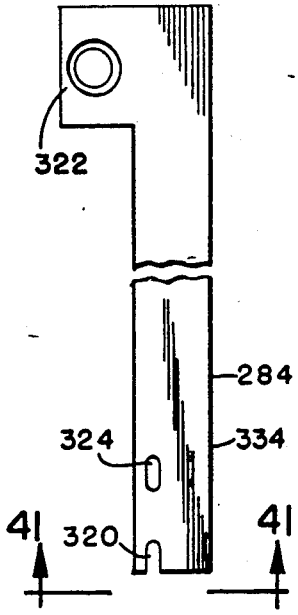
FIG.40
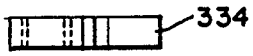
FIG.41
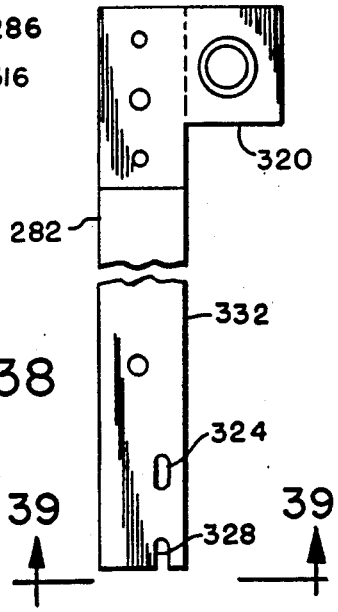
FIG.38
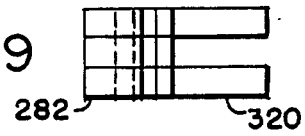
FIG.39

CABLE TERMINATION ASSEMBLY, NIPPING AND KNUCKLING MACHINE, AND METHOD

TECHNICAL FIELD

The present invention relates generally, as indicated, to cable termination assemblies and to methods of making the same, and, more specifically to multiconductor cable termination assemblies particularly useful for high speed signal transmission purposes.

CROSS REFERENCE TO RELATED APPLICATION

Reference is made to copending U.S. patent application Ser. No. 588,652, filed Mar. 12, 1984, now U.S. Pat. No. 4,596,428, the relevant disclosure of which is incorporated by reference. Such patent application discloses a cable termination assembly useful for high speed signal transmission, e.g. as a transmission line cable. The cable termination assembly has plural electrical conductors used to carry high speed electrical signals and plural electrical conductors that are maintained at a reference electrical potential, e.g. relative ground, to isolate the signal carrying conductors; such conductors sometimes being referred to as signal conductors and ground conductors, respectively.

The cable termination assembly also includes plural electrical contacts, an electrical cable of the flat multiconductor type that has the plural signal conductors arranged with each being separated from the adjacent one(s) by one or more of the ground conductors, and a contact carrier, a housing, and a strain relief body molded about the junctions of the contacts and conductors. Each of the contacts is supported on the contact carrier and has a distal contacting end for connection to an external member, e.g. a pin contact, inserted to engagement therewith and also has a junction connecting arm or portion that is bent into a direction generally perpendicular to the major extent of the distal contacting end for electrical connection, e.g. by soldering, to a conductor carried by the cable.

In such cable termination assembly part of the cable insulation is removed intermediate the ends of the cable to expose the conductors. The contacts are mounted on the contact carrier; the signal conductors are soldered to the respective contacts, and the ground conductors are attached to a ground bus or strip. The contact carrier includes relatively raised and recessed surface portions which alternate along the length of the support body portion thereof to facilitate mounting the contacts thereon and to provide separation between signal conductors in the recesses (and attached/connected to respective contacts) and the ground conductors on the raised portions of the contact carrier. The ground bus may include fingers to connect one or more of the contacts to the ground bus.

BACKGROUND

Various techniques have been used to terminate electrical cables that have plural electrical conductors covered or separated by insulation. Typically an electrical connector, sometimes referred to as a cable termination, is coupled to the end of the cable to form a cable termination assembly which facilitates connecting the cable conductors to other cables, terminal boards, printed circuit boards, modular equipment used in computers, etc. Important features of such cable termination assemblies are facility of manufacture and/or use, mechanical strength, security and integrity of electrical connections made therein and thereby, and cost efficiency.

One example of a multi-conductor cable includes plural wires, each including a conductor covered by its own insulation, physically bundled together by a fastener, external sheath or the like. Other multiconductor cables commonly referred to as flat or ribbon cables include plural electrical conductors electrically isolated and held in relative parallel coplanar relation by electrical insulation forming an integral structure. The insulation for such ribbon cable may be of various electrically non-conductive materials such as plastic or plastic-like material, polytetrafluorethylene (Teflon), fiberglass, etc. Typical flat ribbon cables may have multiple conductors therein numbering more than eighty.

In some uses of ribbon cable, such as for high speed signal transmission purposes, it may be desirable electrically to isolate adjacent signal carrying conductors (hereinafter signal conductors, although some also may be connected to a reference potential, e.g. ground potential), by providing one or more conductors therebetween that are maintained at a reference potential, such as ground potential. The isolating conductors are commonly referred to as ground conductors, it however being appreciated that the reference potential may be other than ground, and may be achieved, for example, by connecting alternate conductors of the cable to a ground reference potential.

Examples of prior electrical connectors for electrical cables having signal conductors and ground (isolation) conductors are disclosed in U.S. Pat. Nos. 4,094,564 and 4,310,208. Although the connectors of such patents have desirable attributes, they are coupled to the cable at its end and still require considerable preparation of the cable conductors to position the same for connection in the bifurcated ends of respective contacts that are supported in a directly molded contact carrier body. Such preparation of the conductors is time consuming and a relatively delicate procedure to assure that the conductors are properly formed, are not short circuited, and properly engage with respective contacts.

BRIEF SUMMARY OF INVENTION

According to one aspect of the present invention, a cable termination assembly, which is particularly suited for high speed signal transmission use, includes a multiconductor electrical cable having plural electrical conductors and insulation, electrical contacts for effecting electrical connection between a respective conductor of said cable and a further member, the electrical contacts having a connecting portion for connecting with a respective conductor of the cable and having a contacting portion for contacting with such further member, a separation between two adjacent parts of the insulation for exposing a portion of plural conductors along the major axial extent thereof, at least one of the conductors including at the separation a knuckle bent out of the major axial extent of the conductor for connecting with the connecting portion of a respective electrical contact, and at least a second of the conductors being generally continuous in the major axial extent thereof at the separation, at least one of the insulation parts having been slid along the second of the conductors to close the axial distance of the separation while also pushing part of the knuckle(s) further away from the major axial extent of cable, and a support for supporting the cable and contacts in relatively fixed positions with respect to each other. In a preferred embodiment plural signal conductors are knuckled as described to connect with respective contacts, ground conductors extend generally linearly through the separation to an end of the cable and are connected to each other to provide the desired ground isolation.

According to another aspect of the invention, a method of preparing a flat multiconductor cable for use in a cable termination assembly or for other connection purposes, includes removing the cable insulation from a plurality of the cable conductors at an intermediate location along the length of the cable to expose a plurality of such conductors between respective first and second portions of the cable insulation, knuckling a plurality of the exposed conductors out of the major planar extent of such cable to form a knuckle-like conductor portions for electrical connection to another member, during the knuckling withdrawing an end of at least one of the knuckled conductors into the first insulation portion to prevent exposure of such end beyond the end of the cable, and pushing toward each other the cable insulation at opposite sides of such intermediate location to push out such knuckles generally in a direction perpendicular with respect to the plane of the cable. According to a preferred embodiment and best mode of the invention, plural signal conductors are knuckled and plural ground conductors are connected to each other beyond the cable insulation; the knuckled conductors are connected to respective contacts; and a strain relief body is provided, preferably at least part of the strain relief body being molded directly to and about the junctions of the contacts and knuckled conductors and the proximate cable insulation, thus to form a complete cable termination assembly.

According to an additional aspect of the invention, a method for locating the position of conductors in a multiconductor ribbon electrical cable, e.g. for selective cutting (nipping) or knuckling thereof, includes directing electromagnetic radiation toward such cable, at plural spaced apart locations simultaneously detecting the electromagnetic radiation transmitted through such cable to produce respective signals, and comparing such respective signals to determine the location of respective conductors. According to a preferred embodiment and best mode of the invention, after the conductors are so located, the signal conductors are nipped at the ends to avoid short circuiting with the ground conductors and are knuckled for connection with the contacts; during such knuckling the ends of the signal conductors are withdrawn into the insulation to avoid connection with the ground conductors.

According to still another aspect of the invention, a machine is provided to effect the nipping and knuckling operations in an automated fashion utilizing the aforementioned procedures carried out on the accurately located conductors in the cable.

Still other objectives, aspects and advantages of the present invention include the ability conveniently to daisy chain plural multiconductor cables at a high speed signal transmission cable termination assembly, to facilitate manufacturing of the cable termination assembly, especially while increasing automation and maintaining quality of signal connections and avoidance of undesirable short circuits, and to improve the operability and durability of the cable termination assembly relative to prior devices having similar purposes.

These and other aspects, features, objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 9 is an end elevation view of the contact carrier support of FIG. 8, looking generally in the direction of the arrows 9—9 of FIG. 8;

FIG. 10 is a top or back view of the contact carrier support;

FIGS. 11 and 12 are fragmentary plan and end views of the contacts used in the invention prior to the forming of the contacts;

FIG. 13 is an enlarged side view of a formed contact used in the cable termination assembly;

FIGS. 14, 15, 16, 17, and 18 are, respectively, side, end section, end, bottom, and top views of the cover for the cable termination assembly;

FIG. 28 is a partial left end elevation view showing the knuckling punches and solenoid looking generally in the direction of the arrows 28—28 of FIG. 26;

FIGS. 33 and 34 are, respectively, an exploded isometric view and an assembled isometric view of the nipping tool used in the machine of FIG. 26;

FIGS. 35, 36, and 37 are, respectively, bottom, side and end views of the knuckle punch;

FIGS. 38 and 39 are, respectively, side and end views of the top knuckle arm;

FIGS. 40 and 41 are, respectively, side and end views of the bottom knuckle arm;

DESCRIPTION OF THE PREFERRED EMBODIMENT

Cable Termination Assembly 10

Figure 2:
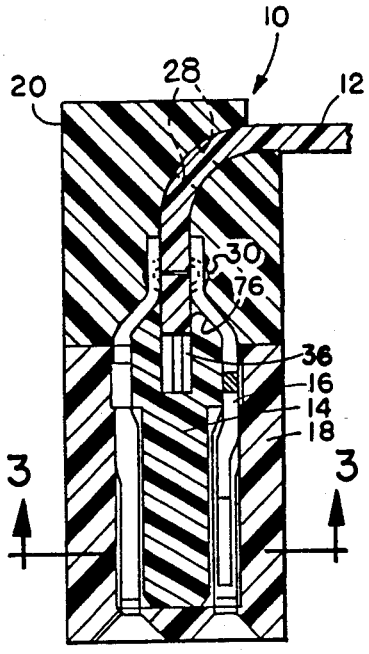
FIG. 2 is a section view of the cable termination assembly of FIG. 1 looking generally in the direction of the arrows 2—2 of FIG. 1—the left-hand contact cell in the cable termination assembly of FIG. 2 is shown for convenience without an electrical contact therein, and the right-hand contact cell is shown with an electrical contact therein.
Figure 1:
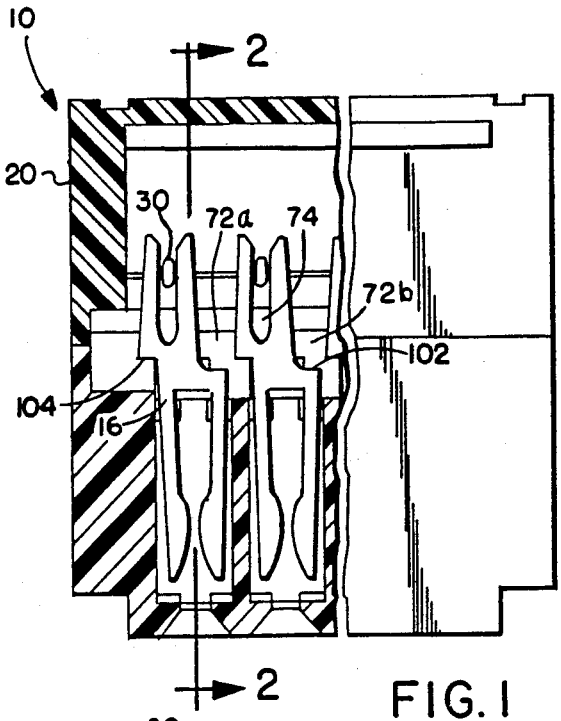
FIG. 1 is a side elevation view, partly broken away in section of a cable termination assembly according to the present invention.
Figure 3:
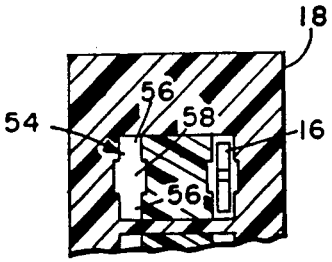
FIG. 3 is a section view of the cable termination assembly looking generally in the direction of the arrows 3—3 of FIG. 2.

Referring, now, in detail to the drawings, wherein like reference numerals designate like parts in the several figures, and initially to FIGS. 1, 2 and 3, a cable termination assembly in accordance with the preferred embodiment and best mode of the present invention is generally designated 10. The fundamental components of the cable termination assembly 10 include a multiconductor electrical cable 12, a contact carrier 14, plural electrical contacts 16, a cover 18, and a strain relief body 20.

In operation of the cable termination assembly 10 the contacts 16 connect respective conductors of the cable to external members such as further contacts to effect electrical connection thereof, as is well known. The cable termination assembly 10 is particularly suitable for high speed signal transmission use in that the cable preferably has plural signal conductors physically and electrically/electromagnetically separated by one or more ground conductors; and the arrangement of the contacts 16 in the assembly and the efficient connection provided the ground conductors generally maximizes the desired ground isolation function. Moreover, the relatively low profile nature of the cable termination assembly further tends to enhance the ground isolation function. As is described further below, the arrangement of conductors and contacts and the interconnection techniques employed therewith enhance the mechanical and electrical integrity of the cable termination assembly 10 while facilitating manufacturing.

Cable 12

Figure 4:
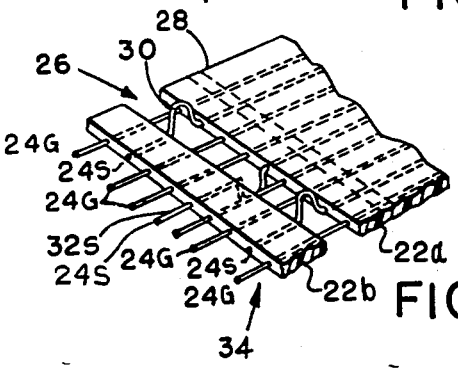
FIG. 4 is an isometric view of a flat multiconductor cable at an intermediate stage of preparation for use in the cable termination assembly of the invention.

As is seen in FIG. 4, the multiconductor cable 12 is of the flat ribbon type. The cable 12 includes electrical insulation 22, for example of Teflon or other matierial that has suitable electrical insulating, durability, etc. characteristics. Teflon material insulation has been found particularly useful for high speed signal transmission cable. The cable also includes a plurality of electrical conductors 24, which are held in spaced apart electrically separated locations therein by the insulation 22. A number of the conductors 24 are designated signal conductors 24S, which are intended to carry electrical signals in the cable termination assembly 10, and a number of the conductors 24 are designated ground conductors 24G, which are intended to provide reference potential (hereinafter ground potential) isolation or separation of the signal conductors, as is well known.

In preparation for use in the cable termination assembly 10, a separation 26 is formed in the cable insulation between a main insulation portion 22*a*, which extends along the major axial extent of the cable 12, and a relatively small axially extending insulation portion 22*b*. Portions of the conductors 24 are exposed within the separation. The separation 26 may be formed using a laser to burn away the insulation across preferably the entire transverse dimension or width of the cable. Such laser also may be used to form a plurality of generally transversely extending strain relief slits 28 in the cable insulation 22; during molding of the strain relief 20 some of the molding material flows into and preferably fills the slits 28 to enhance retention of the cable in strain relief relation in the cable termination assembly 10. Such strain relief slits are particularly useful with Teflon material cable insulation which may not readily bond, secure, or otherwise attach to or with the molding material of which the molded on strain relief 20 is formed.

The conductors 24 preferably are arranged such that each signal conductor 24S has a dedicated pair of ground conductors 24G on opposite sides thereof. Therefore, proximate each lateral edge of the cable 12 is a ground conductor 24G; and the arrangement of conductors across the width of the cable is ground, signal, ground, ground, signal, ground, etc., as is depicted in FIG. 4.

As is described further below, the ends of most of the signal conductors 24S are nipped during the manufacturing of the cable termination assembly 10. Such nipping will allow the withdrawing of such ends into insulation for insulated protection thereof during the knuckling process described further hereinafter.

Knuckles 30 are formed in the signal conductors 24S at the area of the separation 26. The knuckles 30 are formed by deforming the ordinarily straight signal conductors 24S out of the major planar extent of the cable preferably to a height such that part of each knuckle is exposed beyond the exterior surface of the insulation 12. Thus, the knuckles 30 are accessible for connection to respective contacts 16. On the other hand, during such deformation of a signal conductor 24S, the already nipped distal end 32S thereof is withdrawn into the insulation portion **22*b* to maintain electrical isolation thereof from the exposed distal ends 32G of the ground conductors 24G. The distal ends 32G of the ground conductors 24G, though, remain exposed at the area 34 beyond the insulation portion 22b and are connected together preferably by soldering or otherwise electrically attaching the same to a ground strip or bus 36. If it is desired that one or more of the signal conductors 24S is to be used as a ground, then the distal end 32S thereof may be allowed to remain exposed at the area 34 for electrical connection with the exposed ends 32G of the ground conductors 24G**.

The knuckles 30 of relatively adjacent signal conductors 24S preferably face in opposite directions, e.g. up and down or left and right, respectively, as is seen in FIG. 4. The contacts 16 are arranged in two rows in the cable termination assembly, and the alternately facing knuckles 30 facilitate the connection of one signal conductor 24S to a contact in one row and the relatively adjacent signal conductor 24S to a contact in the other row.

(The various references to directions herein, such as up and down, left and right, top and bottom, etc. are simply to facilitate designating respective parts illustrated in the drawings and are not intended to be limiting with respect to the actual location of respective parts during actual use or manufacturing thereof. Generally, longitudinal direction and axial direction may be used interchangeably to identify a direction that follows along the length of the cable 12 and contacts 16, e.g. from the upper right of FIG. 2 curving as the cable enters the strain relief 20, and ending at the bottom of the cover 18 of the cable termination assembly. Lateral or width dimension or direction generally is intended to mean the direction across the width of the cable 12 and of the cable termination assembly that goes across the plural conductors 24 and/or contacts 16 thereof perpendicularly to the axial direction.)

It will be appreciated that although the cable 12 is described with reference to the preferred flat or ribbon multiconductor cable type, other types of cables may be used consistent with the disclosure of the invention herein.

For optimum and uniform ground insulation function by the ground conductors 24G, it is desirable that such conductors be electrically connected to each other. The bus strip 36 helps to assure such electrical connection of the ground conductors 24G.

Figure 5:
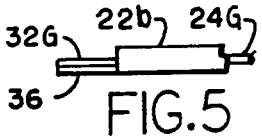
FIGS. 5, 6 and 7 are schematic views of several representative connection arrangements to join the ground conductors of the ground conductors of the cable termination assembly of the invention.
Figure 6:
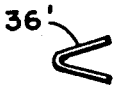
Figure 7:
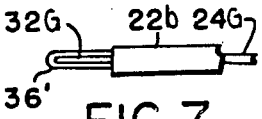

Examples of the bus strip 36 useage are illustrated in FIGS. 5, 6 and 7. In FIG. 5 a flat bus strip 36 that has solder on one surface that is intended to engage the distal ends 32G of the ground conductors 24G. Such distal ends 32G and such surface are placed into engagement and the solder is reflowed to form a good mechanical and electrical connection therebetween. A modified V-shape bus strip 36' is shown in FIGS. 6 and 7. The bus strip 36' is placed over the distal ends 32G of the ground conductors 24G and is bent, crimped or otherwise closed thereon to form an electrical and mechanical connection of the ground conductors. If desired, on at least part of the inside surface of such V-shape bus strip 36' may be a layer of solder, which can be reflowed further to enhance the electrical and mechanical attachment of the ground conductors 24G to each other and to the bus strip 36'. An advantage of the use of the bus strip arrangements disclosed herein is the ability to provide some measure of ground isolation function along the entire length of the cable, assuredly over the entire length of each conductor thereof and even further into the cable termination assembly 10, e.g. as is shown into the carrier 14 (FIGS. 1 and 2).

Contact Carrier 14

Figure 8:
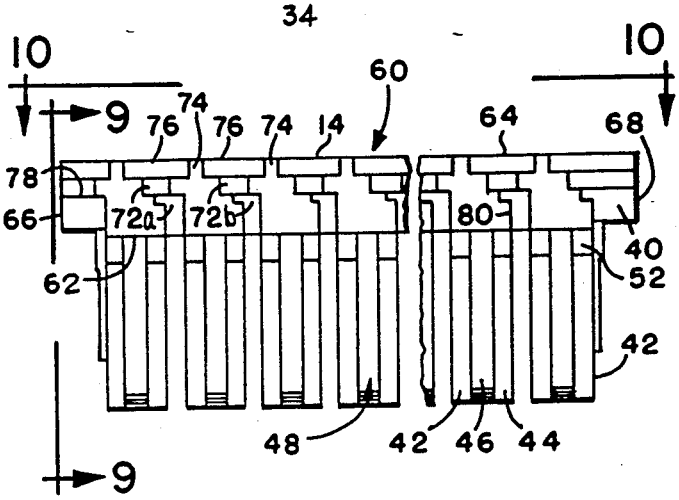
FIG. 8 is a side elevation view of a contact carrier support for the cable termination assembly.
Figure 18:
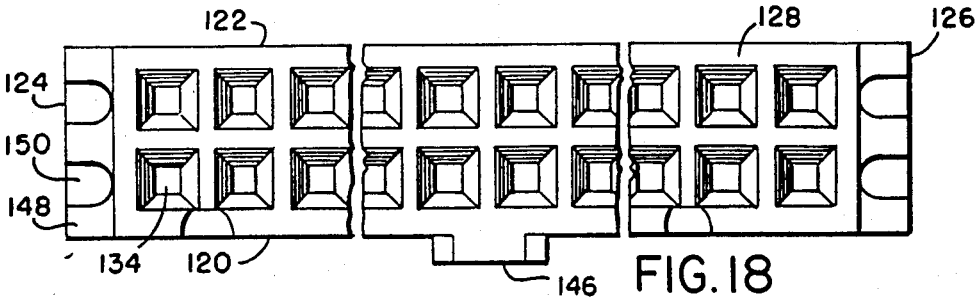
Figure 14:
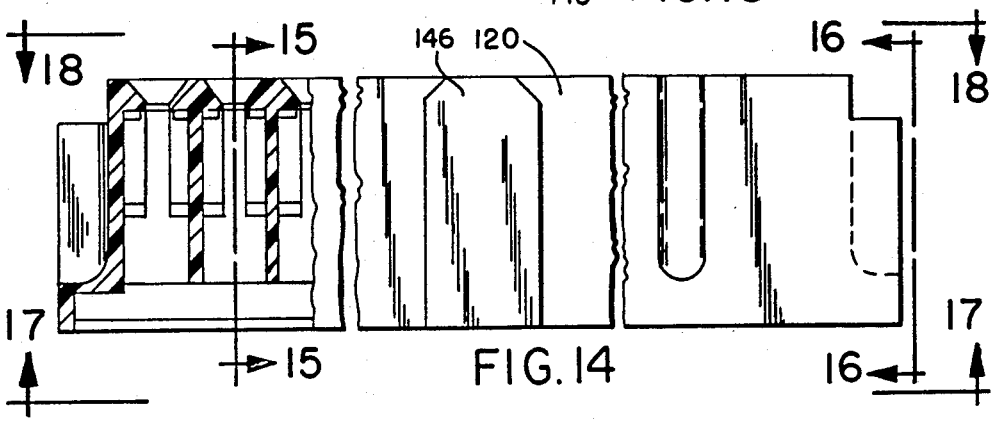
Figure 17:
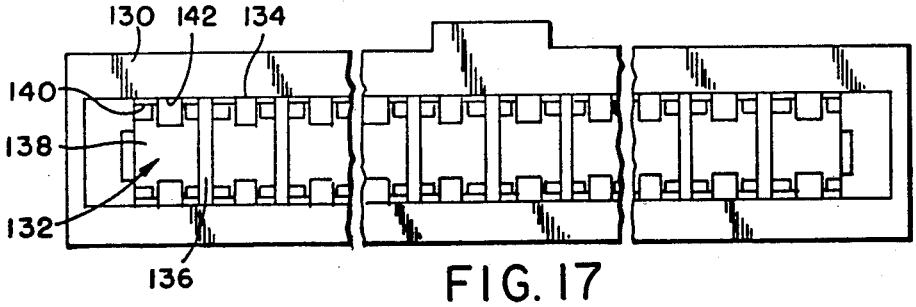

Turning, now, to FIGS. 8–10, the contact carrier 14 is illustrated in detail. The contact carrier 14 is intended to support and to carry the contacts 16 prior to assembly with the cover 18 and to continue to provide a measure of support for and physical separation of the contacts after assembly with the cover 18 and during use of the cable termination assembly 10. Importantly, the carrier 14 preferably may be snap fit at least partly into the cover 18 and assembled with respect to the cover in such way to cooperate with the cover to hold the contacts 16 relatively securely while the knuckles 30 of the signal conductors 24S are attached to the contacts and while the strain relief 20 is molded, as is described in further detail below.

The contact carrier 14 is made of electrically nonconductive material, such as polyester material. The width of the carrier, e.g. from left to right as viewed in FIG. 8, is a function of the number of contacts 16 to be carried thereby and/or of the number of signal conductors 24S of the cable 12 intended to be connected to external members (not shown) by the cable termination assembly 10.

The contact carrier 14 includes a main body portion 40 and a plurality of finger-like projections 42 that extend from the main body, each projection corresponding to and cooperative with a respective contact 16 or pair of contacts (one on each side) to provide support, positioning, and various other functions with respect thereto, as is described further herein. The main body portion 40 extends generally across the width or lateral dimension of the cable termination assembly 10, and each of the projections 42 projects from the main body portion 40 generally in the axial direction of the cable termination assembly. In use of the carrier 14, the projections 42 and at least part of the main body portion 40 extend into the cover 18, for example, as is seen in FIGS. 1, 2 and 3.

Each finger-like projection 42 has a pair of relatively raised fork contact tine support-guide surfaces 44 and a relatively recessed pin contact guide surface 46 between the surfaces 44. The contacts 16, e.g. as is seen in FIGS. 1 and 2, are of the fork contact type having a pair of tines, each of which is intended to align generally over a respective support/guide surface 44. The recessed surface 44 and the space 48 between the surfaces 44 cooperate to guide a pin contact (not shown) or other similar external member to properly aligned physical and electrical engagement with the tines of the contact 16. A chamferred lead in wall 50 at the leading end of the recessed surface 46 provides further guidance for insertion of a pin contact into the cable termination assembly 10. At the end of the surfaces 44 proximate the main body are sloped surfaces 52, which lead up to the plane level of the main body portion 40, as is seen clearly in FIG. 9.

As is described further below, the surfaces 44, 46 of each finger-like projection 42 cooperate with corresponding surfaces within the cover to define a cross core zone 54 shown most clearly in FIG. 3. Such cross core zone provides relatively narrow lateral and thickness defined or limited areas 56 along the axial extents of both tines of the contact 16 that permits minimal, but adequate, deformation and travel of the contact 16 tines, while providing support thereof and restricting the maximum tine deformation to avoid an over travel condition that would permanently deform the contact beyond its elastic limit. On the other hand, at the central area of the cross core zone 54, i.e. between the tines, is a relatively wide open space 58 defined in part by the recessed surface 46 and a corresponding surface of the cover 18 that permits limited non-axial alignment of the inserted pin contact while guiding the same to proper engagement with the tines of the fork contact 16.

Since it is preferred, according to convention, that contacting portions, i.e. the tines, of the contacts 16 be arranged generally in a dual-in-line pattern, each of the finger-like projections 42 is generally identically formed on both the top and bottom lateral surfaces, only the top surface being illustrated in FIG. 8. However, the top 60 and bottom lateral surfaces of the main body portion 40 of the contact carrier 14 are similar to each other but are of opposite phase in order to provide retention of the contacts 16 on both surfaces thereof while enabling the connecting ends of each pair of contacts supported by or aligned with a particular projection 42 to be laterally offset with respect to each other. Such offset permits each such pair of contacts to connect respectively with the knuckles of relatively adjacent signal conductors 24S, as is described further herein.

Referring to FIG. 8, for convenience of description, the main body portion 40 has an axially leading edge 62, an axially trailing edge 64 and left and right ends 66, 68. As is seen in FIGS. 2 and 9, penetrating to the interior of the main body portion 40 is a slot 70, which extends along the lateral width of the main body portion to accomodate the ground conductors 24G and the ground bus 36.

To retain the electrical contacts 16 on the top surface 60 of the contact carrier 14, a number of stepped or offset walls generally designated 72 are formed on such surface. Specifically, relatively adjacent stepped walls, such as those designated **72*a*, 72*b* cooperate with a main base portion of a contact placed therebetween to retain the contact in place, as is seen more clearly in FIG. 1, for example. For additional contact positioning function, a tab 74 protrudes out of the lateral surface 60 beyond the chamferred plane of sloped walls 76 proximate the axially trailing edge 64 of the carrier 14. The tab 74 fits in a slot between the bifurcated arms of the contact connecting portion, as also is seen most clearly in FIG. 1. The stepped walls 72 proximate the left and right ends 66, 68 of the carrier 14 are continuous to such ends, as is seen in FIGS. 8 and 10**.

As is seen most clearly in FIG. 10, the arrangement of stepped walls 72 and tabs 74 for positioning and retaining contacts 16 on the contact carrier are different on the opposite lateral surfaces and may be referred to as being oppositely out of phase. That is, along the lateral or width dimension of the carrier the tabs 74 on one surface, e.g. surface 60, are located half way between a pair of tabs on the other surface. Similarly, the offset or stepped positioning and retaining walls 72 on one surface face the opposite direction, i.e. are reversed, from the facing direction of the stepped walls 72 on the other surface and, of course, are appropriately aligned with respect to each other and corresponding tabs 74 for proper positioning and retention of contacts 16 thereby.

The sloped walls 76 proximate the axially trailing edge 64 of the contact carrier accommodate a bend in the connecting end of the contacts, as is seen in FIG. 2, for example. Such bend allows the connecting ends of the contacts in both rows to be positioned relatively close to each other to receive the oppositely facing knuckles 30 of the cable signal conductors 24S, as is shown in FIGS. 1 and 2.

As is seen most clearly in FIGS. 8 and 9, part of each stepped offset wall 72 is in one plane and part is in another generally parallel plane with a small step 78 separating the two planes. Such step 78 and the relatively raised part 80 of the offset wall 72 are provided to cooperate with a corresponding recessed area in the cover 18 for a snap fit retention of the carrier 14 (and contacts 16 thereon) to the cover 18. It is noted that for simplification of illustration since such step 78 is relatively small it does not appear in the illustration of FIG. 10.

Electrical Contacts 16

The electrical contacts 16 are shown in detail in FIGS. 11, 12 and 13. Each contact 16 has a main base portion 82, a contacting portion 84 and a connecting portion 86. The contacting portion 84 includes a pair of generally linearly extending tines 88 as in the case of a typical fork contact, each tine having a curved contacting area 90. A pin contact ordinarily would be inserted between the tines 88 to engage the contacting areas 90 making an electrical connection with the fork contact. The connecting portion 86 extends away from the base 82 generally in the opposite direction from which the contacting portion 84 extends. The connecting portion is bifurcated and includes a pair of legs 92 defining a slot 94 therebetween. The slot 94 includes a relatively wide portion **94*a* proximate the base 82 for receiving therein a tab 74 of the contact carrier 14 and a relatively narrow 94*b* portion for electrically connecting with a knuckle 30 portion of a signal conductor 24S**.

Preferably each contact 16 has an offset bend 98 at the area where the tines are proximate the base and/or at the base itself to enable the tines to follow relatively closely the sloped wall 76 and the linear walls 44 of the finger-like projections 42 of the contact carrier 14. Also, the contact base 82 and/or legs 92 are bent at 100 to provide the desired following of the shape of the contact carrier 14 and to place the connecting portions 86 of the paired contacts in the two parallel rows thereof relatively proximate each other for close fitting with the cable 12 and knuckles, as is seen in FIG. 2, for example.

Furthermore, the contacting and connecting portions as well as the base portion of the contacts 16 have the illustrated shoulders 102, 104 which together with the generally linearly extending proximate portions of the tines and/or legs 92 cooperate with the stepped offset wall portions 72 of the contact carrier 14 to result in proper positioning and retention of the contacts on the contact carrier 14. Moreover, plural contacts 16 are attached to a temporary support strip 106 forming a so called contact comb. The support strip 106 holds such contacts relative to each other and facilitates the retention of the contacts on the carrier 14 prior to insertion of the contacts and carrier into the cover 18. After such insertion the support strips 106 may be broken away at the weakened zones 108 and discarded leaving the slots 94 open for sliding therein of respective knuckles 30.

To enhance the mechanical and electrical connection of the knuckles 30 to the contacts within the slot 94 bounded by the legs 92, solder 110 may be coated on the contacts; and such solder may be reflowed using various techniques that apply appropriate heat for such purpose to join each knuckle mechanically and electrically with the adjacent legs 92. In one example such reflowing of the solder may be accomplished by induction heating, either before or after the strain relief body 20 has been molded in place; in other examples heat may be applied by a laser or by a conventional soldering instrument.

Cover 18

The cover 18, which is shown in detail in FIGS. 15–18, covers the contacting portion of the contacts 16 and cooperates with the contact carrier 14 to form a cross-core cell 54, as is seen in FIGS. 1–3, to constrain movement of the contact tines and to guide a pin contact properly to engagement with the contact tines. By constraining such movement of the contact tines, the possibility of damage to the contacts 16 during insertion of a pin contact that is misaligned or is slightly oversized and/or the possibility of further misalignment damage to such pin contact are minimized.

Accordingly, the cover 18 has lateral walls 120, 122, left and right end walls 124, 126, front wall 128, bottom wall 130, and a hollow interior area 132. Openings 134, which are tapered, as shown, provide access for a pin contact to be inserted into the interior of the cover, more particularly to a particular cross core cell 54 for engaging a fork contact 16 therein. Divider walls 136 separate respective adjacent cell pair areas 138 in the interior 132 of the cover 18. Thus, in each cell pair area 138 one of the finger-like projections 42 of the contact carrier 14 is inserted to form a pair of cross-core cells, as is seen in FIG. 3, for example. Within each cell pair area of the cover 18 are several tine support/deformation limiting surfaces 140 on opposite sides of each opening 134 that cooperate with the raised surfaces 44 of the contact carrier finger-like projections 42 to define the cross-core configuration of each cell 54. The openings 134 have one wall that leads as a smooth transition to the interior of a lateral wall 120, 122 of the cover to provide a recessed area 142 between each pair of raised surfaces 140.

A shallow recess or groove-like area 144 is formed in the interior faces of the lateral walls 120, 122 to cooperate with the wall or surface 80 of the contact carrier 14 to hold the latter in place in the cover in snap fit relation. Various key-like and tab-like protrusions and recesses, such as those designated 146, 148, 150, may be provided on the cover 18 for proper polarity and/or other positioning control when the cable termination assembly is connected with another socket, cable termination assembly or the like, not shown, during use thereof.

As part of the process of making the cable termination assembly 10 of the invention, respective combs of contacts 16, as are illustrated in FIG. 11, for example, are placed on the respective opposite sides of the contact carrier 14 and are held in position thereon as aforesaid; the contact carrier and contacts are then inserted into the cover 18 to the mentioned snap fit relation, thereby forming a contact carrier, contacts, and cover sub-assembly. The temporary contact support strip 106 may be broken off at the weakened zones leaving the connecting portions of the contacts 16 exposed in paired alignment, as is shown in FIGS. 1 and 2, ready for the insertion of a cable 12 therebetween for connection of the knuckles 30 to respective contact as aforesaid. During such placement of the cable 12 with respect to the contacts 16 to connect the signal conductors 24S with respective contacts, the ground bus 36 and the exposed ends 32G of the ground conductors 24G are inserted into the slot 70 of the contact carrier 14.

Moreover, after such placement of the cable and possibly soldering the knuckles 30 to the contacts 16, the strain relief body 20 may be molded in place. Importantly, due to the ability essential to pre-assemble the sub-assembly just described and to secure the cable with respect thereto, both by the placement of the bus strip 36 in the slot 70 and by connection of the knuckles to the contacts, there is a secure positioning of the cable and sub-assembly prior to the step of molding of the strain relief body 20. Therefore, during such molding the possibility that the flowing molding material would interfere with the proper positioning and connection of the various other parts of the cable sub-assembly and connected/positioned cable is minimized.

Strain Relief Body 20

Preferably the strain relief body 20 is formed of electrically non-conductive material that is molded directly of and about the junctions of the contacts 16 and respective signal conductor 24S knuckles 30 to form a hermetic, i.e. air and moisture free, seal thereof to maintain the integrity of the connections therebetween. Moreover, at least some of such molding material may penetrate into the area of the slot 70 to fill up space and/or to seal the area where the ground bus 36 is located. Importantly, the molding material of the strain relief 20 penetrates, preferably fills, and solidifies in the slits 28 formed in the cable insulation 22 thereby securing the cable in position in cable termination assembly and generally avoiding the application of strain to the contact/conductor connections in case a force were applied tending to pull the cable away from the strain relief 20.

The material of which the strain relief 20 is made may be of a type that bonds with the cable insulation and/or with the material of which the contact carrier 14 and/or cover 18 are made. In such case the strain relief 20 may be molded in such a way as to bond with such other part(s) of the cable termination assembly 10 further increasing the overall structural integrity thereof.

Shielded Cable Termination Assembly 160

Figure 19:
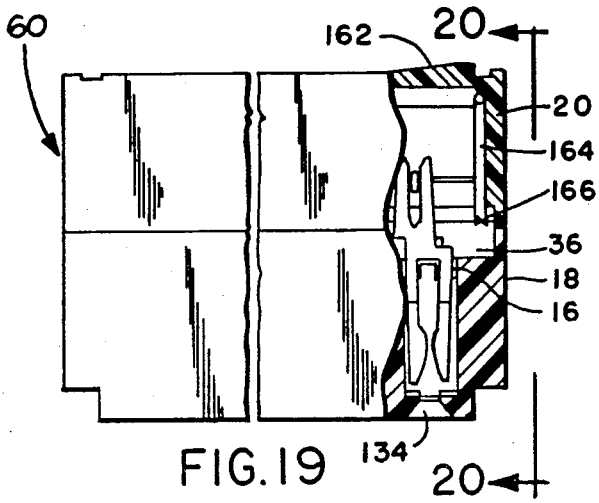
FIG. 19 is a side elevation view, partly broken away in section, of a modified cable termination assembly for a shielded flat ribbon cable.
Figure 20:
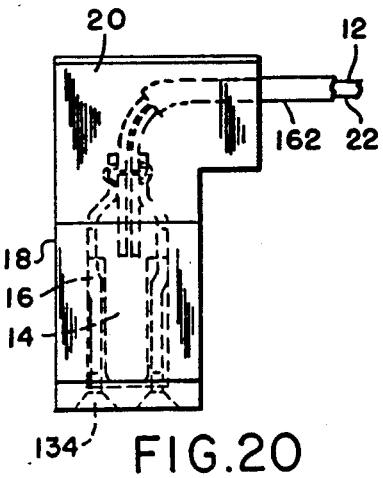
FIG. 20 is an end elevation view of the modified cable termination assembly looking generally in the direction of the arrows 20—20 of FIG. 19.

Referring to FIGS. 19 and 20, a shielded cable termination assembly 160 is illustrated. The shielded cable termination assembly 160 is generally similar to the cable termination assembly 10 described above; however, the cable 12 has an electrically conductive shield 162 about the conductors and at least part of the insulation thereof to provide conventional shielding functions, for example. Such shield 162 may be a foil material wrapped about the outside of the cable 12. As is conventional, one or more drain wires 164 may be provided between the shield foil material 162 and the cable insulation 22.

As is seen in FIGS. 19 and 20, the cable conductors 24S and 24G are connected to the contacts 16 and ground bus 36 in the manner described above. However, preferably the drain wire 164 is soldered to the ground bus 36 before the strain relief 20 is molded, as is shown at 166, and both the shield 162 and the drain wire 164 are contained in the molded strain relief 20 in the manner shown to complete the cable termination assembly 160 shown. The slits 28 may be used in the cable to cooperate with the strain relief material 20 as aforesaid.

Pull Tab Configurations

Figure 21:
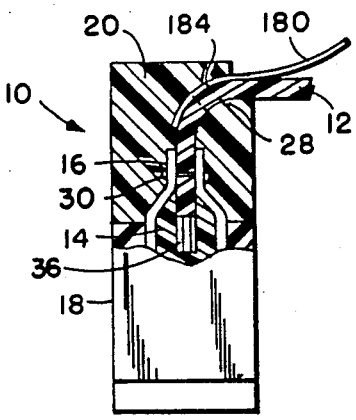
FIGS. 21, 22, and 23 are views of a cable termination assembly according to the invention with a pull tab to facilitate removing the assembly from connection with another electrical connector.
Figure 22:
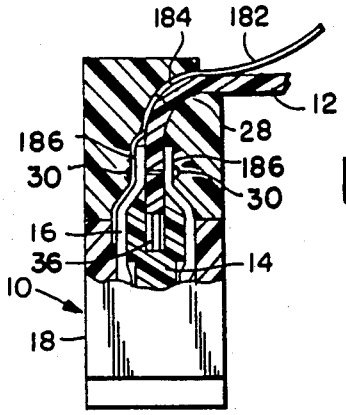
Figure 23:
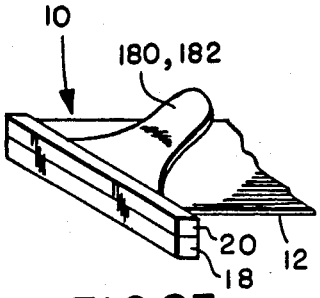

The several embodiments of the cable termination assembly disclosed herein may include a pull tab to facilitate removing the cable termination assembly from a set of pin contacts in another connector, socket, etc. while minimizing strain applied to the cable itself and/or to the cable termination itself. In FIGS. 21 and 22 are shown two examples of pull tabs 180, 182 used with a cable termination assembly 10, for example. FIG. 23 shows the outside view of such cable termination assembly with pull tab.

The pull tab 180 has slits 184 therein and is placed over the cable 12 preferably with the slits 184 generally aligned with the slits 28 in the cable insulation 22 or in any event in such a way as to avoid blocking flow of molding material into the slits 28 while permitting the flow of molding material into the slits 184. Therefore, during the molding of the strain relief 20, the molding material thereof penetrates the slits 184 and secures the pull tab 180 in the manner illustrated. Moreover, the pull tab and molding material may be compatible to the extent that the molding material bonds to the pull tab as the strain relief is molded.

The pull tab 182 extends over the small extent of the knuckles 30 that protrude above the plane of the contacts 16, as is seen in FIG. 22. Accordingly, the pull tab 182 has a plurality of openings 186 therein for the purpose to pass such knuckle portions therein helping to position the pull tab with respect to the contacts while the strain relief 20 is molded. Such openings 186 also permit molding material to penetrate the same and, thereby, to secure the pull tab in the strain relief 20. The pull tab 182 also may include slits 184 further to receive molding material therein still further to secure the pull tab within the strain relief.

Daisy Chain Cable Termination Assembly 190

Figure 24:
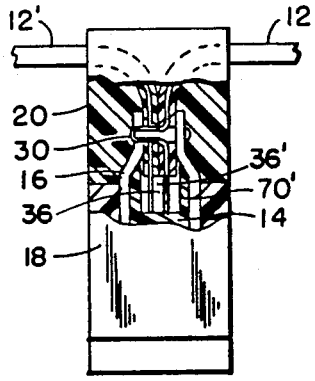

An advantage of the present knuckle configuration/connection of conductors 24 and contacts 16 is the ability to provide a convenient daisy chain type cable termination assembly, as is shown at 190 in FIG. 24. In such assembly 190 two cables 12, 12' are prepared with knuckling of the signal conductors 24S. The knuckles 30 of one cable are interleaved with the knuckles 30 of the other cable. In this way one signal conductor 24S of one cable is connected electrically to a corresponding signal conductor 24S of the other cable, and both signal conductors may be connected at the interleaved/connected knuckles thereof to the connecting portion of a respective contact 16 in the manner described above, for example with reference to the cable termination assembly 10. The ground conductors 24G of the two cables 12, 12' may be connected together at the ends 32G with a pair of ground bus strips 36, 36', which preferably are soldered together to complete a line therebetween. To accommodate the thicker bus strip and the plural cables, the contact carrier 14 may have a wider slot 70' than the slot 70 described above for a single cable; also, the contact connecting portions may be bent in such a way as to permit inserting of the plural cables therebetween, as is seen in FIG. 24, without affecting the spacing or positioning of the contacting portions of the contacts. Furthermore, to assure secure retention of the cables 12, 12' in the strain relief body 20, the same may include additional material in the height dimension, as is viewed in FIG. 24, relative to the amount of such material used in the strain relief bodies described above with respect to the single cable assemblies 10, 160.

Thus, the present invention permits convenient daisy chain configurations without requiring special connectors, sockets, etc. and minimizing the space required to effect a daisy chain connection arrangement.

Cable Preparation

Figure 25A:
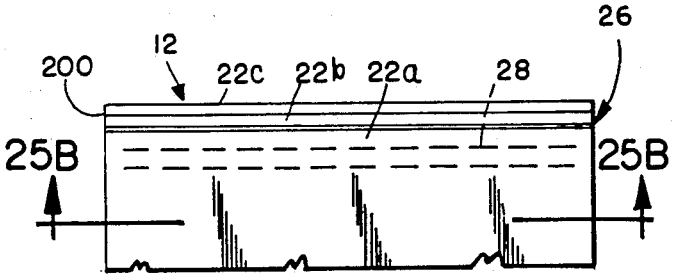
FIGS. 25A and 25B are views of the flat multiconductor cable used in the cable termination assembly of the present invention in a state of being partially prepared by laser burning operation to form separate sections of cable insulation and to form strain relief openings in the insulation.
Figure 25B:
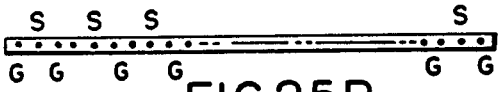
Figure 27:
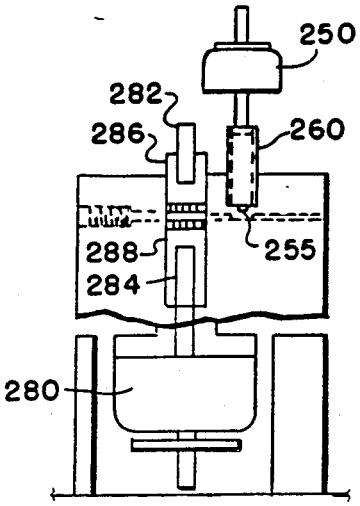
FIG. 27 is a fragmentary section/elevation view of the machine of FIG. 26 showing the nipping punch and the knuckling punches looking generally in the direction of the arrows 27—27 of FIG. 26.
Figure 29:
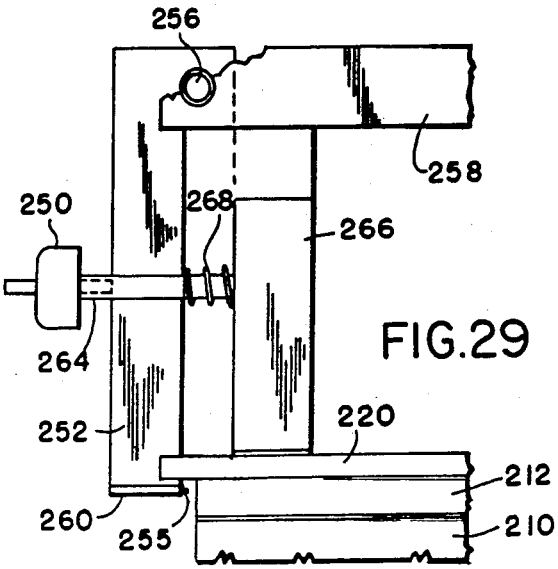
FIG. 29 is a partial right end elevation view of the nipping punch and solenoid looking generally in the direction of the arrows 29—29 of FIG. 26.

Referring briefly to FIGS. 25A and 25B, a flat or ribbon type multiconductor cable 12 is shown prepared for use in the cable termination assemblies described herein except for the forming of the knuckles 30. Accordingly, such cable 12 has insulation 22 and conductors 24. Such conductors include plural signal conductors 24S and a respective dedicated pair of ground conductors 24G at the side of or adjacent each signal conductor. Moreover, the slits 28 are seen spaced back from the separation 26.

During preparation of the cable 12, a laser is used to form the slits 28 and the separation 26. Moreover, the laser is used to form an additional narrow separation line 200 through the insulation 22 proximate the end of the cable where the ground conductors ultimately are to be exposed for connection to the ground bus 36. The narrow separation line 200 separates a disposble strip **22*c* of insulation from the insulation portion 22*b*; such disposable strip may be removed by sliding the same along the ends 32** of the conductors.

With the cable 12 prepared as shown in FIGS. 25A and 25B, a machine 201 is used to nip those signal conductors 24S that are not intended to be connected to the ground conductors 24G at the respective exposed ends 32 thereof and to form the knuckles 30 in the signal conductors 24S. The nipping takes place in the zone of the line 200 so that when the knuckles are formed the ends of the nipped signal conductors are withdrawn into the insulation portion **22*b*. The knuckling takes place in the separation zone 26, as is shown in FIG. 4, for example. Moreover, after the nipping and knuckling has been completed, preferably the insulation portion or strip 22*c* is removed leaving the ends 32G of the ground conductors 24G (and the end(s) of any signal conductors 24S** that were not nipped and are intended also to be connected to ground) exposed for connection to the ground bus, or in any event for connection together.

Figure 46:
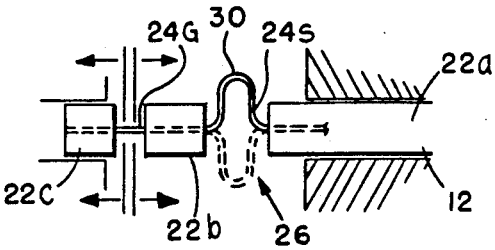
FIG. 46 is a schematic side elevation view showing the flat multiconductor cable of the invention at an intermediate preparation stage with the signal conductors nipped and knuckled and the ground conductors and nipped off ends of the signal conductors retained in a temporarily grasped disposable end piece of insulation.
Figure 47:
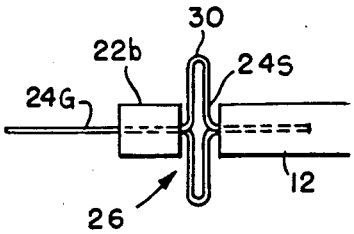
FIG. 47 is a schematic side elevation view similar to FIG. 46 but showing a part of the cable insulation having been slid along the signal conductors while the protrusion of the knuckles is emphasized.

During, before, or after the removal of the of the insulation strip **22*c*, the insulation strip 22*b* is slid along the ground conductors 24G toward the insulation portion 22*a* thereby to reduce the size of the separation 26 between the insulation portions 22*a*, 22*b* while also preferably slightly bending the signal conductors at the knuckles 30 to push up the knuckles further above the plane of the outside surface of the insulation 22. Such pushed up knuckles are more readily available, then, for connection to the contacts 16. To effect such pushing, the insulation portion 22*a* may be clamped in the machine 201 or in another machine, as is illustrated in FIG. 46**. Then a force is applied for pushing the insulation portion 22*b* toward the insulation portion 22*a*. The insulation portion 22*c* is removed to expose the ground conductor ends 24G. The finished and thusly prepared cable is shown in FIG. 47. Nip and Knuckle Machine 201

The machine 201 is illustrated in the several views of FIGS. 26–44. The fundamental components of the machine 201 are a movable support table or platform 202 on which the cable 12 is mounted, a nipping assembly 204 to effect the desired nipping of signal conductors 24S, and a knuckling assembly 206 that effects the desired knuckling of the cable signal conductors 24S, as was described above. Preferably the machine 201 is operated under control of a conventional computer that may be programmed in a conventional manner to carry out the several functions described herein. Primarily such functions are those of position detection and control and movement both of the table 202 to which the cable is clamped and movement of the appropriate parts of the nipping and knuckling assemblies 204, 206.

Figure 26:
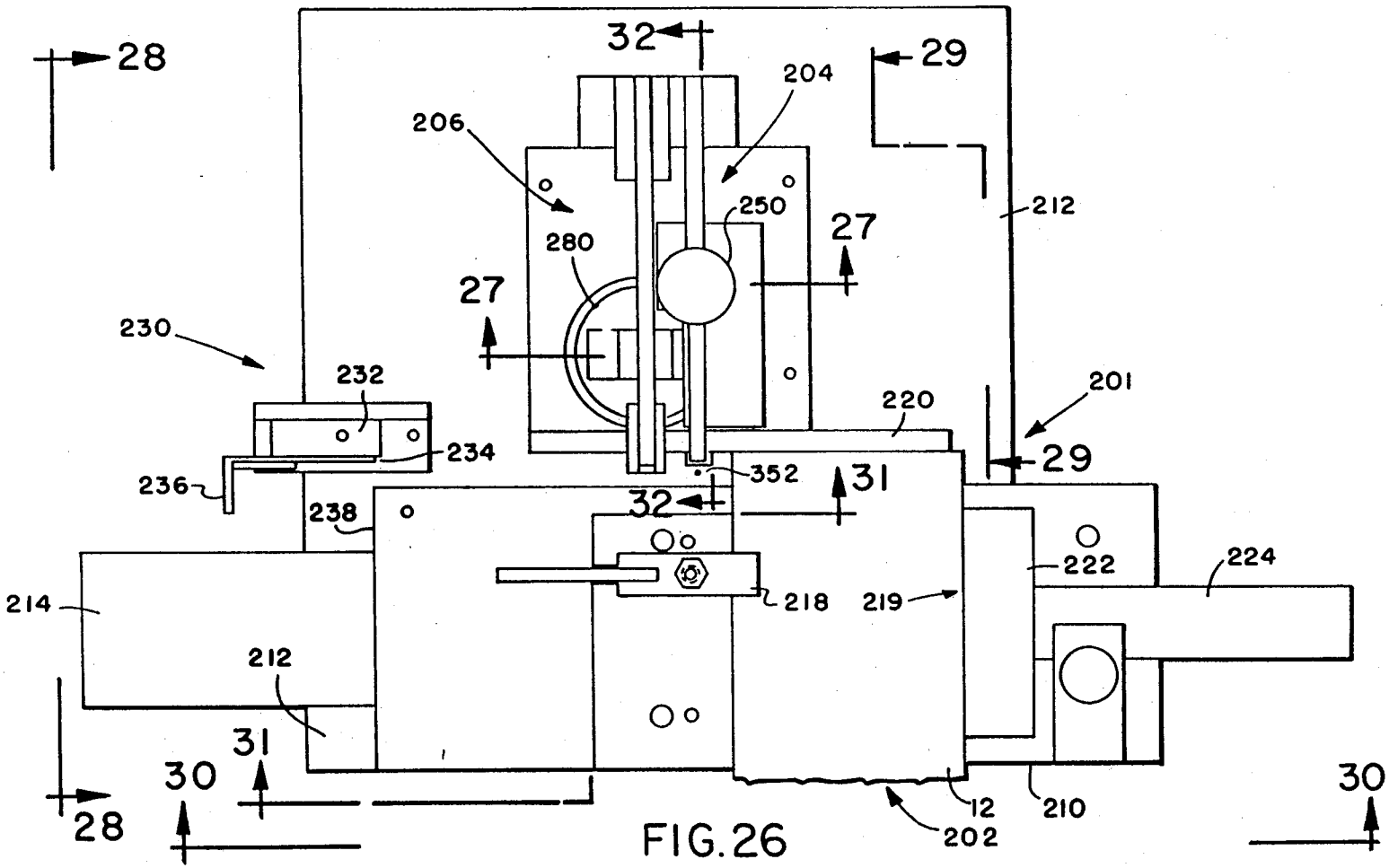
FIG. 26 is a top plan view of a nipping and knuckling machine for use in manufacturing the cable termination assembly of the present invention, particularly to perform the nipping and knuckling preparation of the cable.

The table 202 includes a movable support platform 210 mounted to slide on a fixed base 212. As it is viewed in FIG. 26, the table platform 210 is in the load/unload cable position with the cable 12 fully out of alignment with the nipping and knuckling assemblies. However, essentially, relative to the base 212 the platform 210 may move to the left to bring the cable to such assemblies or to the right to bring the cable to the location illustrated in FIG. 6. A motor 214 may effect such movement of the platform by turning a screw (not shown) in a conventional manner. A cable clamp 218 mounted to the platform 210 clamps the cable 12 thereto to prevent sliding or other movement of the cable relative to the platform during operation of the machine 201 to prepare the cable by appropriate nipping and knuckling. A cable edge guide 219 may be slid to an appropriate location along the table to guide the right hand edge of the cable in a proper position on the table, and a slide stop 220 limits maximum insertion depth of the cable, as is seen in FIG. 26. The edge guide 219 includes a slidable guide member 222 mounted on a slide 224, which may be secured to a desired position by a clamp 226.

A limit switch 230 limits left-hand movement of the table platform 210. Such limit switch includes a hall effect switch 232 that is caused to produce a limit signal that may be interpreted by the computer to stop further left-hand movement. More particularly, the vane 234 is positioned to be engaged by the edge of the cable 12 at the outermost, i.e. closest to the edge, exposed ground conductor 24G in the separation area or gap 26, when the table is moved left; upon such engagement, the hall effect switch sense the same and produces the limit signal. Similarly, a table limit arm 236 may extend downwardly from the vane to be engaged by the left edge 238 of the platform 210 at the extreme left travel position thereof causing the hall effect switch to produce such limit signal. Operation of the motor 214 preferably is under control of the computer (not shown) to effect the desired movement of the table 202. According to the preferred embodiment and best mode of the invention, the vane/hall effect switch combination 232, 234 accurately measure or detect the left edge of the outermost ground conductor of the cable 12, and this information may be used with the optics portion of the machine 201 described in further detail below with respect to FIGS. 43–45 to locate the conductors in the cable for accurate nipping and knuckling operations.

Figure 30:
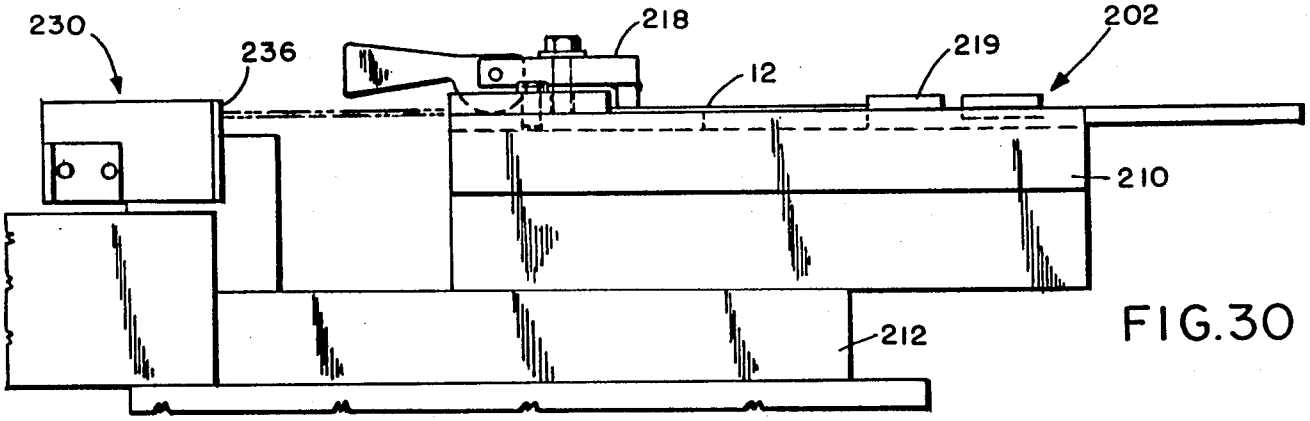
FIG. 30 is a front elevation of the machine looking generally in the direction of the arrows 30—30 of FIG. 26 and showing the cable clamping and slide mechanism.
Figure 32:
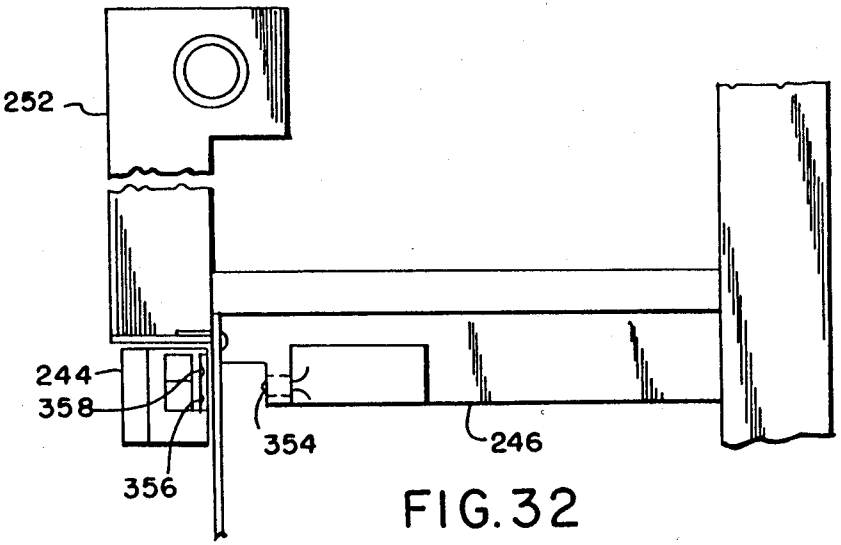
FIG. 32 is a fragmentary right end elevation/section view of the optical cable conductor locating mechanism and the nipping punch looking generally in the arrows 32—32 of FIG. 26.
Figure 31:
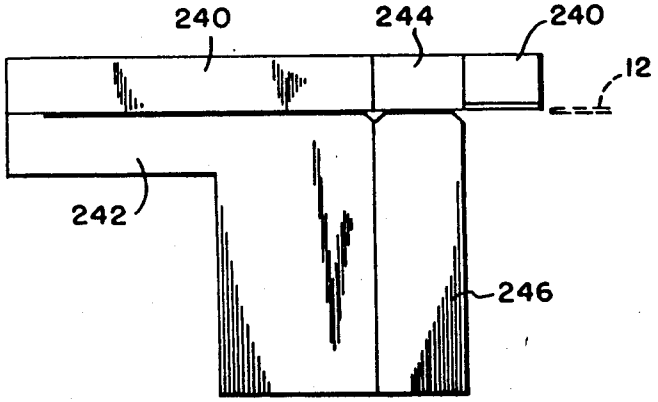
FIG. 31 is a fragmentary front elevation/section view of the machine looking generally in the direction of the arrows 31—31 of FIG. 26.
Figure 42:
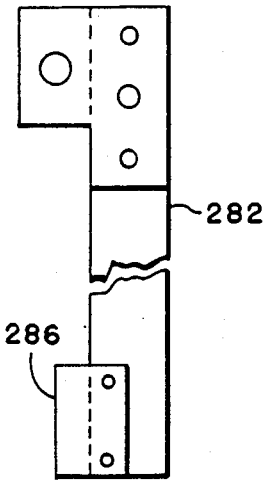
FIG. 42 is a side elevation view of an assembled knuckle arm and knuckle punch.

The table 202 and cable clamp 218 are seen in FIG. 30. Moreover, upper and lower cable guides 240, 242, which guide the cable during movement thereof into alignment with the nipping and knuckling assemblies 204, 206, and the mounts 244, 246, respectively for a photosensor and light emitting diode conductor location detector system are shown in FIG. 31. Further details of such detector system and operation thereof are described further below; the objective of such system, though, is to detect actual locations of the conductors in the cable in order to provide appropriate information concerning the same to the computer (not shown) that controls table movement and where the nipping and knuckling operations will occur.

Nipping assembly 204, which is shown in detail in FIGS. 27, 29, 33 and 34, includes a nip solenoid 250, a nip support arm 252, and a nip punch or blade 254 with a sharp cutting tooth 255. The nip support arm 252 is mounted by a pivot arrangement 256 to a standing support 258, which is secured to the base 212. The nip punch is fastened to the end of the arm 252 by a securing bracket 260 and screw 262. The nip solenoid 250 is mounted in the manner illustrated in FIG. 29 from a support member 264, which is attached to a support bar 266. A spring 268 urges the nip support arm 252 away fromt he bar 266; however, upon energization of the solenoid 250, the latter pulls the nip support arm toward the bar 266 causing the nip punch 254 to nip or to cut an aligned signal conductor in the cable 12. Upon deenergization of the solenoid 250, the spring 268 again returns the nip support arm 252 and nip punch 254 upwards, e.g. as is viewed in FIG. 27 (to the left in the view of FIG. 29).

As is seen in FIGS. 27, 28, and 35–42, the knuckling assembly 206 includes a knuckle solenoid 280, upper and lower knuckle support arms 282, 284, and a pair of knuckle punches 286, 288. The knuckle support arms are mounted by a pivotal arrangement 290 for relative pivotal movement with respect to each other and with respect to a fixed support 292, which is secured to the base 212. The solenoid 280 is mounted in the manner shown relative to the two knuckle support arms 282, 284 by a support bracket 294 and bar 296; and a spring 298 normally urges the support arms 282, 284 away from each other. Upon energization of the solenoid 280, this effects a pulling action to draw the support arms 282, 284 toward each other against the force of the spring 298. Such pulling motion causes the knuckle punches 286, 288 to effect knuckling of respective signal conductors aligned therewith. A stop bar 300 limits the maximum travel of the knuckle punches 286, 288 and associated knuckle support arms to prevent damaging the cable by motion of the knuckle punches beyond the required amount to effect knuckling.

Details of the knuckle punches 286, 288 are shown in FIGS. 35–37. The punches 286,288 preferably are identical, each having five punch prongs 310 protruding from the flat surface 312 in a slightly off-set position arrangement. Such off-set arrangement and the spacing between the respective prongs 310 assures that the five prongs on the punch 286 will knuckle several, preferably five, signal conductors in one direction while simultaneously the other punch 288 will knuckle several, preferably five, signal conductors, which are spaced between the first-mentioned signal conductors, in the opposite direction. The knuckle punches have a U-shape mounting wall arrangement 314 with a screw opening 316 in one such wall and a threaded opening 318 in the other for fastening of the respective punches to respective knuckle support arms in the manner illustrated in FIG. 42, for example.

At the back end of the knuckle support arm 282 is a U-shape wall arrangement 320; and at the back end of the knuckle support arm 284 is a straight wall 322, which fits in between the wall portions 320. In this way proper alignment of the support arms 282, 284 is maintained while the same are permitted to undergo the limited pivoting travel described above to effect the desired knuckling. Openings 324, 326 and slots 328, 330 in the blade portions 332, 334 of the support arms 282, 284 accommodate the mounting screws (not shown) for the knuckle punches 286, 288.

The relative positions of the nipping and knuckling arrangements 204, 206 are illustrated in FIG. 26. During travel of the cable 12 the beneath the nipping punch and between the knuckling punches the same are withdrawn to avoid interfering with such travel. During nipping operation only the nipping punch is used; during the knuckling operation only the knuckle punches are used.

Figure 43:
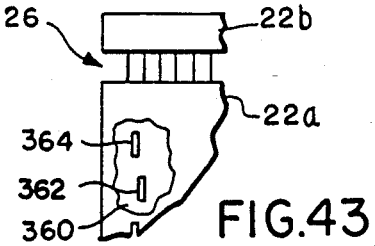
FIGS. 43 and 44 are schematic representations of the optical cable conductor locating system according to the present invention, FIG. 43 depicting a top plan view of the cable and the off-set locations of the two photosensors, and FIG. 44 being an end elevation view.
Figure 44:
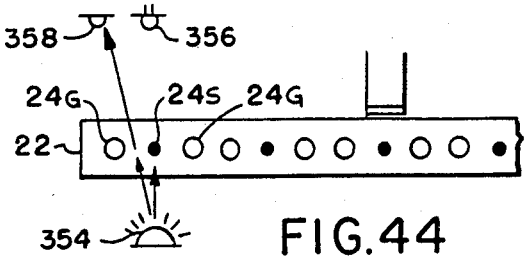

An optics assembly 350 illustrated in detail in FIGS. 43 and 44 detects the locations of conductors in the cable 12. A dot 352 in FIG. 26 represents the positioning of the optics assembly and the optics mounting mechanisms 244, 246 of FIG. 31 also indicates positioning of the optics assembly 350 in the machine 201. Moreover, in FIG. 32 the mounting structure 244, 246 for the optics assembly 350 also is illustrated in relative alignment with respect to the nip support arm 252, for example.

The optics assembly 350 includes a light source 354, such as a light emitting diode, a pair of photosensors 356, 358, and a mask 360 with narrow openings 362, 364 therein to limit the exposure or line of sight of the photosensors. Light from the LED 354 is directed toward the cable 12, and some of such light is passed to the respective photosensors 356, 358 through the narrow slit-like openings of the mask 360. Due to the off-set positioning of the photosensors, as is shown and due to the light refraction that will occur as light is transmitted through the cable 12, as the cable is moved past the optics arrangement 350 while clamped to the table 202, for example, the photosensors will produce two signals identified A and B in the graph of FIG. 45.

Figure 45:
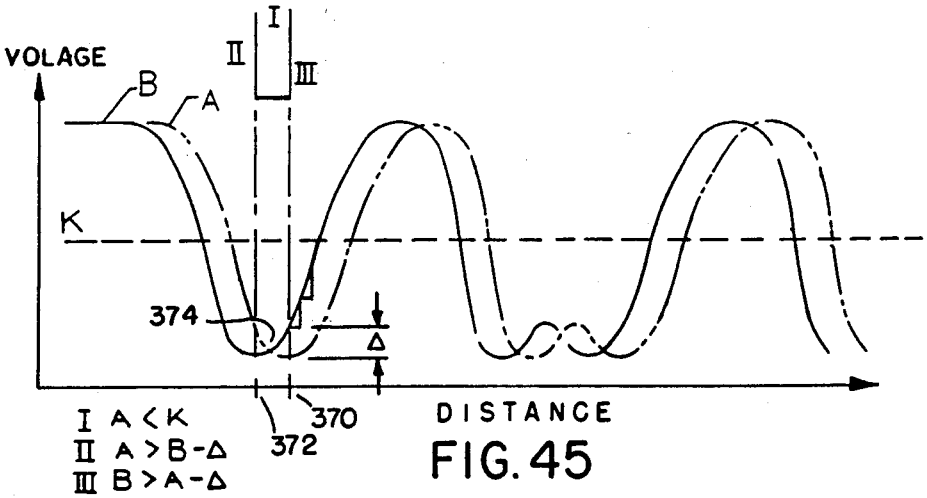
FIG. 45 is a graph of the detected signals used in the otical cable conductor locating system.

The shape of the signals is representative and may vary somewhat from that shown; however, generally the outputs of the photosensors will vary as conductors respectively are moved into and out of the light path from the light source 354 to the photosensors. As is seen in FIG. 45, the minimum of the A signal will occur at location 370; the minimum of the B signal will occur at location 372. The distance between the respective minima and the immediately above portion of the other signal is identified by the Greek letter delta. Where both signals A and B cross at 374 would be the ideal location of the conductor being searched out; however, due to the refraction of light, curvature of the cable and various other uncontrollable conditions, it is likely that the actual location of the conductor may be somewhat off-set from such location 374. But, it is likely that the actual location is at a location between the minima 370, 372. Moreover, the location of such minima in the curves of the graph of FIG. 45 should generally correspond with the off-set spacing of the slits 362, 364 in the mask 360.

To communicate such location to the computer, then, a set of equations I, II and III is presented in FIG. 45. Such set of equations being satisfied will cause the computer to detect actual conductor location for use to effect nipping and knuckling. Eauation I assures that the A signal is below a predetermined constant value. If the A signal is below such constant, then the B signal will be below that value. This assures that the area being searched is a minimum and not a maximum. Equations II and III, namely that the value of signal A is greater than the value of signal B minus delta and the value of signal B is greater than the signal A minus delta will place the location between the minima 370, 372. With all three equations satisfied, conductor location is known with accuracy. Such location can be correlated with the original edge location detected by the limit switch 230 to be used by the computer in moving the table 202 and to effect the nipping and knuckling operations.

Method

Briefly summarizing operation of the invention, then, the sub-assembly of the contact carrier 14, contacts 16, and cover 18 is made. The cable is separately prepared. Finally, the cable is inserted with respect to the sub-assembly and is soldered to the contacts of the sub-assembly, and the strain relief 20 is molded in place.

Such cable preparation includes the following steps. The separation lines and slits are formed in the cable insulation 22, as was described, for example using a laser. The cable is placed in the machine 201. The location of the conductors in the cable is detected using the switch 230 and the optics assembly 350. The selected signal conductors are nipped. The signal conductors are knuckled. The insulation strip 22*c* is removed and the knuckles are enlarged as the insulation portion 22*b* is slid toward the insulation portion 22*a* to narrow the separation 26, and the ground conductors are soldered to the ground bus 36. The cable is inserted to the sub-assembly and is soldered to the contacts of the sub-assembly and the strain relief is molded in place.

We claim:

1. A cable termination assembly, comprising a flat multiconductor electrical cable having plural electrical conductors and insulation extending along an axial extent of said cable, electrical contact means for effecting electrical connection between a respective conductor of said cable and a further member, said electrical contact means having a connecting means for connecting with a respective conductor of said cable and having contacting means for contacting with such further member, said insulation having two adjacent parts separated along the axial extent of said cable and forming therebetween a separation in said insulation exposing a portion of said plural electrical conductors, said separation having a substantially uniform axial dimension in the direction of the axial extent of said cable which is no greater than the thickness of said cable insulation, at least one of said conductors including at said separation knuckle means bent out of the major axial extent of the conductor for connecting with the connecting means of a respective electrical contact means, at least a second of said conductors being generally continuous in the major axial extent thereof at said separation, and said knuckle means projecting away from the major axial extent of said one of said conductors by a distance no less than said axial dimension of said separation means, and support means for supporting said cable and contacts in relatively fixed positions with respect to each other and for enclosing said exposed portion of said plural electrical conductors.

2. The assembly of claim 1, said knuckle means including a generally U-shape portion of said at least one of said conductors, and said U-shape portion having a length at least twice its width.

3. A cable termination assembly, comprising a multiconductor electrical cable having plural electrical conductors and insulation means for holding said conductors in generally parallel, planar, spaced apart relation, electrical contact means for effecting electrical connection between a respective conductor of said cable and a further member, said electrical contact means having a connecting means for connecting with a respective conductor of said cable and having contacting means for contacting with such further member, and strain relief means for holding said cable and contact means relatively in fixed positions with respect to each other, said strain relief means comprising electrically non-conductive material molded directly to and about at least part of said insulation means, conductors, and contacts, said insulation means having strain relief opening means formed therein for receiving at least a portion of said strain relief means therein during such molding and for cooperating with said portion of said strain relief means when solidified therein to enhance the integrity of mechanical connection between said cable and said strain relief means, said strain relief means having said portion thereof molded directly into said strain relief opening means and solidified therein , and said insulation means having a portion thereof transversely adjacent said strain relief opening means which portion maintains longitudinally spaced parts of said insulation on opposite sides of said strain relief opening means integrally joined together.

4. The assembly of claim 3, said opening means exposing therein at least one of said conductors.

5. The assembly of claim 4, said opening means exposing therein a plurality of said conductors, and said strain relief means enclosing such exposed portions of said conductors.

6. The assembly of claim 3, said opening means comprising a plurality of slits in said insulation means.

7. The assembly of claim 3, said opening means including a plurality of transversely spaced apart slits, and said insulation means having respective portions thereof between relatively adjacent pairs of said slits which portions maintain parts of said insulation on opposite longitudinal sides of said slits integrally joined together.

8. The assembly of claim 7, said slits being elongated in a direction transverse to the longitudinal extent of said electrical cable.

9. A cable termination assembly, comprising two multiconductor electrical cables, each having plural electrical conductors and insulation, electrical contact means for effecting electrical connection between a respective conductor of both of said cables and a further member, said electrical contact means having a connecting means for connecting with said respective two conductors and having contacting means for contacting with such further member, each of said cables having separation means between two adjacent parts of said insulation thereof for exposing a portion of plural conductors along the major axial extent thereof, at least one of said conductors of each of said cables including at said separation means knuckle means bent out of the major axial extent of the conductor for connecting with the connecting means of a respective electrical contact means, and at least a second of said conductors being generally continuous in the major axial extent thereof at said separation means, plural knuckle means of one of said cables being interleaved with plural respective knuckle means of the other of said cables forming electrical connections between respective pairs of conductors of said cables, and support means for supporting said cables and contacts in relatively fixed positions with respect to each other.

10. A cable termination assembly, comprising a multiconductor electrical cable having plural electrical conductors and insulation, plural electrical contact means for effecting electrical connection between a respective conductor of said cable and a further member, said electrical contact means having a connecting means for connecting with a respective conductor of said cable and having contacting means for contacting with such further member, carrier means for carrying said contact means, said carrier means including plural parallel fingers for supporting said contact means in one plane while permitting freedom of movement of said contact means in a direction parallel to said one plane, and retaining means for retaining plural contact means in relative positions to each other on said carrier means, said contact means having shoulder means for cooperating with said carrier means to retain said contact means on said carrier means, and said retaining means having step means for cooperating with said shoulder means to retain said contact means in relative positions on said carrier means, said step means including a row of spaced apart, stepped walls, said stepped walls cooperating with relatively adjacent stepped walls to retain therebetween respective said contact means, and said shoulder means of each said contact means including opposed shoulders on opposite sides of said contact means engaging relatively adjacent stepped walls for retention therebetween, and housing means for containing at least part of said contact means and carrier means.

11. A cable termination assembly, comprising a multiconductor electrical cable having plural electrical conductors and insulation, plural electrical contact means for effecting electrical connection between a respective conductor of said cable and a further member, said electrical contact means having a connecting means for connecting with a respective conductor of said cable and having contacting means for contacting with such further member, carrier means for carrying said contact means, said carrier means including plural parallel fingers for supporting said contact means in one plane while permitting freedom of movement of said contact means in a direction parallel to said one plane, a space between respective adjacent fingers, and base means for holding said fingers in relative position, said contacting means being positionable to extend in a generally parallel overlying relation with a respective finger, said carrier means including an extended locking surface, and housing means for holding together in snap fit relation said carrier means and contact means, said housing means having a hollow interior portion and including extended locking surface means within the interior thereof for cooperating with said extended locking surface of said carrier means to hold the latter at least partly in said interior.

12. The assembly of claim 11, said housing means having interior wall means for fitting in the space between respective fingers to cooperate with such fingers to form contact chamber areas for containing respective contacting means therein.

13. The assembly of claim 11, said extended locking surface comprising plural surfaces, at least a plurality of which are each positioned generally between a respective pair of contact means.

14. The assembly of claim 13, said extended locking means comprising a stepped wall at least substantially circumscribing the interior of said housing means.

15. A cable termination assembly, comprising a multiconductor electrical cable having plural electrical conductors and insulation, plural electrical contact means for effecting electrical connection between a respective conductor of said cable and a further member, said electrical contact means having a connecting means for connecting with a respective conductor of said cable and having contacting means for contacting with such further member, carrier means for carrying said contact means, said carrier means including plural parallel fingers for supporting said contact means in one plane while permitting freedom of movement of said contact means in a direction parallel to said one plane, a space between respective adjacent fingers, and base means for holding said fingers in relative position, said contacting means being positionable to extend in a generally parallel overlying relation with a respective finger, and housing means for holding together in snap fit relation said carrier means and contact means, said housing means having interior wall means for fitting in the space between respective fingers to cooperate with such fingers to form contact chamber areas for containing respective contacting means therein, and said electrical contact means comprising fork contacts each including a pair of generally planar, elongate tines, said housing means having exterior wall, the inside surface of said exterior wall and said fingers having a groove therein aligned generally between the tines of each fork contact to form a deeper space therebetween for accomodating a further member inserted to engagement with said tines within said chamber.

16. The assembly of claim 15, wherein said housing means interior wall means define first area means for permitting deflection of said contacting means in one direction during insertion or withdrawal of such a further member and said fingers and inside surface of said exterior wall means are spaced apart a first distance for preventing substantial deflection of said contacting means in a second direction orthogonal to said one direction, and said grooves define second area means for guiding such a further member in a generally linear direction to engage said contacting means while deflecting said contacting means in said one direction, said grooves including further wall portion means for defining said second area means and being spaced apart a second distance greater than said first distance.

17. A cable termination assembly, comprising a multiconductor electrical cable having plural electrical conductors and insulation, plural electrical contact means for effecting electrical connection between a respective conductor of said cable and a further member, said electrical contact means having a connecting means for connecting with a respective conductor of said cable and having contacting means for contacting with such further member, carrier means for carrying said contact means, said carrier means including plural parallel fingers for supporting said contact means in one plane while permitting freedom of movement of said contact means in a direction parallel to said one plane, and retaining means for retaining plural contact means in relative positions to each other on said carrier means, said contact means having shoulder means for cooperating with said carrier means to retain said contact means on said carrier means, and said retaining means having step means for cooperating with said shoulder means to retain said contact means in relative position on said carrier means, said contact means having an opening therein, and said carrier means having tab means protruding from a surface thereof for fitting into said opening to position said contact means with respect to said carrier means, and housing means for containing at least part of said contact means and carrier means.

18. The assembly of claim 17, said contact having bifurcated arms and said opening comprising a space between said arms.

* * * * *

UNITED STATES PATENT AND TRADEMARK OFFICE

CERTIFICATE OF CORRECTION

PATENT NO. : 4,722,692

DATED : February 2, 1988

INVENTOR(S) : John N. Tengler, Dennis J. London, & Chris H. Shamtovich

It is certified that error appears in the above-identified patent and that said Letters Patent is hereby corrected as shown below:

Column 3, line 16, delete "a" after —form—.

Column 5, line 23, after "in" add —direction of the—.

Column 5, Line 42, correct the spelling of "optical".

Column 6, line 24, correct the spelling of "material".

Column 7, line 62, correct the spelling of "usage".

Column 12, line 34, "of" (first occurrence) should be —to—.

Column 14, line 56, delete "of the" (first occurrence).

Column 15, line 4, "Nip and Knuckle Machine 201" is a heading.

Column 15, line 53, "sense" should read —senses—.

Column 18, line 3, correct the spelling of "equation".

Column 22, line 4, correct the spelling of "accommodating".

Signed and Sealed this

Fifth Day of March, 1991

*Attest:*

HARRY F. MANBECK, JR.

*Attesting Officer*

*Commissioner of Patents and Trademarks*